US005755343A

United States Patent [19]

Harvey, Sr.

[11] Patent Number: 5,755,343

[45] Date of Patent: May 26, 1998

[54] WALL SHELF WITH INTEGRAL ARTICLE RECEPTICAL

[75] Inventor: Louis A. Harvey, Sr., Detroit, Mich.

[73] Assignees: Louis Harvey, Sr., Detroit; John D. Harvey, Sr., Southfield, both of Mich.

[21] Appl. No.: 741,943

[22] Filed: Oct. 31, 1996

[51] Int. Cl.[6] ..... A47F 5/08

[52] U.S. Cl. ..... 211/90.01; 47/66.6; 47/41.01

[58] Field of Search ..... 211/90, 87, 90.01; 108/42, 48; 47/66.6, 41.01, 39

[56] References Cited

U.S. PATENT DOCUMENTS

| | | | |
|---|---|---|---|
| 342,675 | 5/1886 | Braddock . | |
| 508,149 | 11/1893 | Schumm . | |
| 1,402,904 | 1/1922 | Skidmere . | |
| 1,758,130 | 5/1930 | Shoemaker . | |
| 1,777,542 | 10/1930 | Baerman . | |
| 1,970,370 | 8/1934 | Foser . | |
| 2,217,454 | 10/1940 | Pfeiffer . | |
| 2,219,975 | 10/1940 | Bentz | 211/90 X |
| 2,389,349 | 11/1945 | Eastman | 211/90 X |
| 2,686,988 | 8/1954 | Garber . | |
| 2,720,056 | 10/1955 | Levy | 47/66.6 X |
| 3,008,585 | 11/1961 | McNeill | 108/42 |
| 3,118,250 | 1/1964 | Harvey . | |
| 3,675,882 | 7/1972 | Dibble | 211/90 X |
| 3,704,776 | 12/1972 | Collins | 47/66.6 X |
| 4,212,133 | 7/1980 | Lufkin . | |
| 4,584,213 | 4/1986 | Rentowl . | |
| 5,085,002 | 2/1992 | Lee et al. . | |
| 5,095,649 | 3/1992 | Brownlee | 47/41.01 |
| 5,586,409 | 12/1996 | Jamieson | 47/41.01 |

FOREIGN PATENT DOCUMENTS 13731 of 1910 United Kingdom .

*Primary Examiner*—Jose V. Chen
*Attorney, Agent, or Firm*—Peter D. Keefe

[57] ABSTRACT

A wall shelf for being mounted to a wall, either a flat wall or a wall corner, wherein a receptacle is integrally formed with the shelf for anchoring an object to the shelf. The wall shelf is composed of a shelf member having a top surface and an opposite bottom surface, mounting members connected with the shelf member for mounting the shelf member to a wall, a stabilizing member projecting downwardly from the bottom surface of the shelf member, and a receptacle integrally formed collectively in each of the shelf member and stabilizing member. The receptacle is in the form of a blind bore, having a bore opening at the top surface of the shelf member and a bore terminous inside the receptacle. In operation, a user mounts the wall shelf to a wall. Thereupon, the user places stems of artificial flowers into the receptacle, whereupon the flowers are anchored to the wall shelf. The wall shelf and the flowers provide a decorative synergism unmatched by a conventional shelf.

20 Claims, 1 Drawing Sheet

WALL SHELF WITH INTEGRAL ARTICLE RECEPTICAL

BACKGROUND OF THE INVENTION

1. Field of the Invention

The present invention relates to shelves connected with walls. More particularly, the present invention relates to a shelf structured to interface with either a wall corner or a flat wall. Still more particularly, the present invention relates to a wall shelf having an integrally formed receptacle into which an article is anchorable with respect to the shelf.

2. Description of the Prior Art

Shelves are connected to walls for practical and decorative purposes, whereby objects may be stored or displayed conveniently against a wall. Typically, shelves provide a flat surface upon which objects rest. Shelves are connected with the wall usually using some anchoring component, such as a nail, screw or picture hanger hook.

As shown in FIG. 1, a conventional shelf 10, for example, is structured to be placed abuttingly against the walls 12 of a wall corner 14. The shelf 10 includes a plurality of flat shelf members 16 each having a top surface 16*a*, wall attachment members 18, and a plurality of shelf connectors 20 which interconnect the shelf members. Objects, such as for example ceramics, vases, or various nicknacks are placed restingly upon the top surface 16*a* of the shelf members 16. In this regard, the objects are just sit on the shelf members 16, so that they are subject to being accidentally dislodged therefrom.

Accordingly, what remains needed in the art is a shelf for interfacing with a wall, wherein an object placed thereupon may be selectively anchored thereto.

SUMMARY OF THE INVENTION

The present invention is a wall shelf for being mounted to a wall, either a flat wall or a wall corner, wherein a receptacle is integrally formed with the shelf for anchoring an object to the shelf.

The wall shelf according to the present invention is composed generally of a shelf member having a top surf ace and an opposite bottom surface, mounting members connected with the shelf member for mounting the shelf member to a wall, a stabilizing member projecting downwardly from the bottom surface of the shelf member, and a receptacle integrally formed collectively in each of the shelf member and stabilizing member.

The shelf member may include a right angle rear edge for abuttingly interfacing with a wall corner or a straight rear edge for abuttingly interfacing with a flat wall. The receptacle is in the form of a blind bore, having a bore opening at the top surface of the shelf member and a bore terminous inside the receptacle.

In operation, a user mounts the wall shelf to a wall. Thereupon, the user places an object upon the shelf member. Particularly in this regard, the user places stems of artificial flowers into the receptacle, whereupon the flowers are anchored to the wall shelf. The wall shelf and the flowers provide a decorative synergism unmatched by a conventional shelf.

Accordingly, it is an object of the present invention to provide a wall shelf for abuttingly interfacing with either a wall corner of a flat wall, the wall shelf having an integrally formed receptacle.

It is an additional object of the present invention to provide a wall shelf having an integrally formed receptacle, wherein the receptacle serves to anchor an object placed partly therein.

These, and additional objects, advantages, features and benefits of the present invention will become apparent from the following specification.

DETAILED DESCRIPTION OF THE PREFERRED EMBODIMENT

Figure 2:
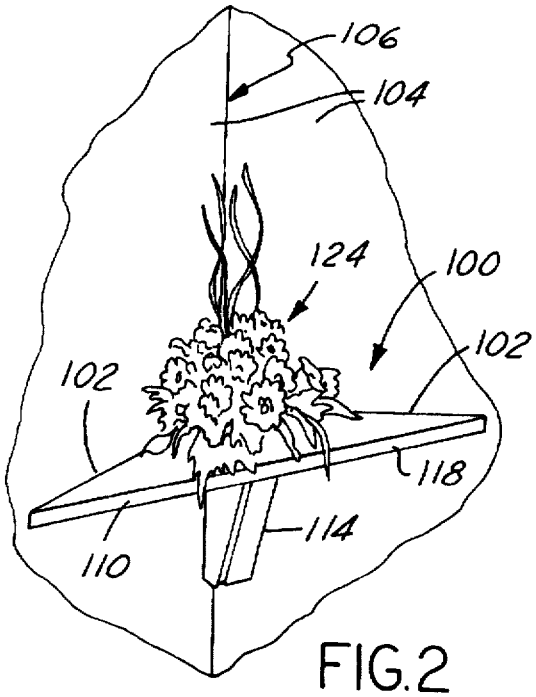
FIG. 2 is a perspective view of a wall shelf according to the present invention, shown in operation abuttingly interfaced with respect to a wall corner and a floral object anchored thereto.
Figure 1:
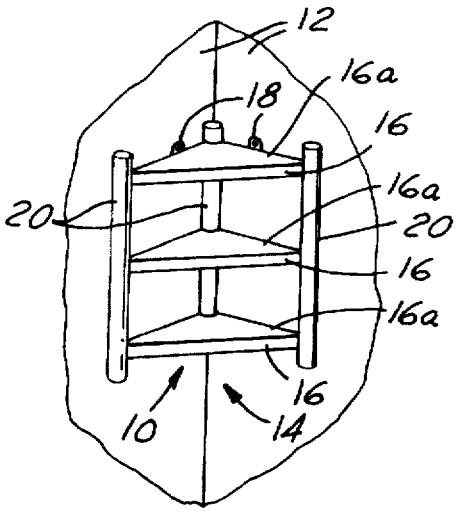
(PRIOR ART) FIG.1
FIG. 1 is a perspective view of a prior art wall shelf.

Referring now to the Drawing, FIGS. 2 through 5 depict a wall shelf 100, 100' according to the present invention for being mounted hangably with respect to a wall. In this respect, it will be seen that the wall shelf 100, shown in FIGS. 2 through 4, has a right angle rear edge 102 for abuttingly interfacing with the adjoining walls 104 of a wall corner 106, and the wall shelf 100', shown in FIG. 5, has a straight rear edge 108 for abuttingly interfacing with a flat wall 104'.

Figure 4:
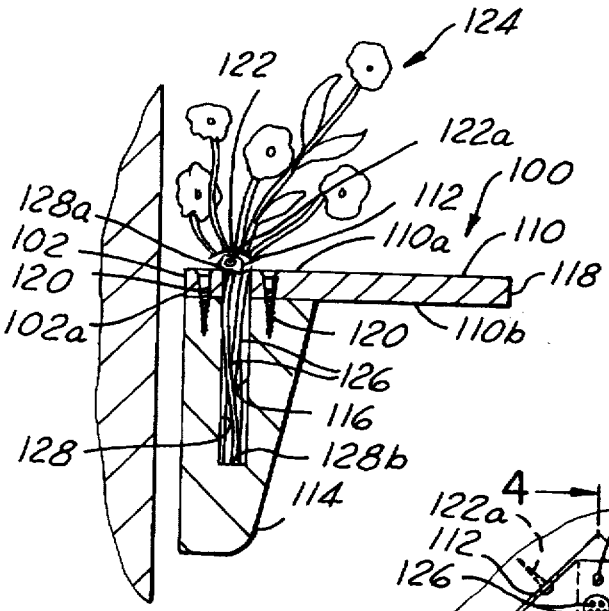
FIG. 4 is a sectional side view taken along line 4—4 of FIG. 3 of the wall shelf according to the present invention, shown in operation abuttingly interfaced with respect to a wall corner and a floral object anchored thereto.
Figure 3:
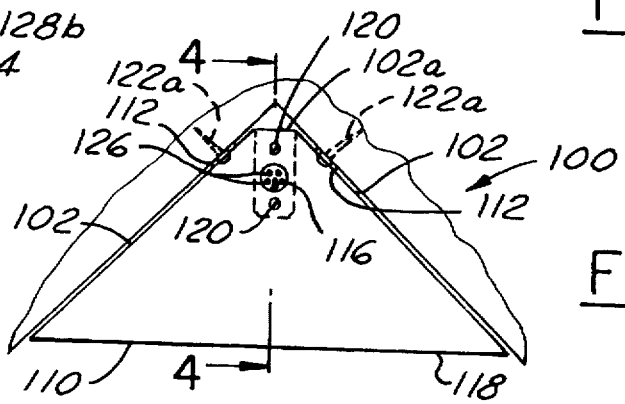
FIG. 3 is a top plan view of the wall shelf according to the present invention, shown in operation abuttingly interfaced with respect to a wall corner.

As best seen in FIGS. 3 and 4, the wall shelf 100 is composed of a shelf member 110 having a top surface 110*a* and an opposite bottom surf ace 110*b*, mounting members 112 connected with the shelf member for mounting the shelf member to the wall 104, a stabilizing member 114 projecting downwardly from the bottom surface 110*b* of the shelf member, and a receptacle 116 integrally formed collectively in each of the shelf member and stabilizing member.

The shelf member 110 is has a general wedge shape, characterized by a truncated right angle rear edge 102. The truncation 102*a* of the right angle rear edge 102 is preferred, but is not a structural requirement. The right angle rear edge 102 is structured to abuttingly interface with adjoining walls 104 of a corner 106, as shown in FIG. 2, and best shown in FIG. 3. The shelf member 110 is planar; consequently, the top surface 110*a* is flat. The front edge 118 of the shelf member 110 may be straight, as shown, or may be fancifully curved or otherwise contoured. A preferred material of construction of the shelf member 110 is a wood product, such as a wooden board, plywood or pressed particulate board, which is covered by a durable covering, such as FORMICA. Other materials can be used for the shelf member 110, such as for example plastic.

The stabilizing member 14 is located abutting the bottom surface 110*b* of the shelf member 110, and coterminally adjoins the truncation 102*a* of the right angle rear edge 102. The stabilizing member 114 projects perpendicularly in relation to the bottom surface 110*b* sufficient to serve as a stabilizing abutment in relation to the walls 104 of the wall corner 106 and the mounting members 112 so that the self member 110 is supported from tipping at the front edge 116 when objects are placed thereupon. Preferably, the stabilizing member 114 is constructed of the same material as the shelf member 110. The stabilizing member 114 is connected with the shelf member 110 via any conventional affixment mechanism, such as threaded fasteners (ie., screws) 120. The stabilizing member 114 is preferably tapered, as depicted in the Drawing, but this is not required.

The mounting members 112 are connected with the shelf member 110 such that connection to the walls 104 may be effected at or above the top surface 110*a*. A preferred mounting member 112 is a metal bracket 122 which has a first portion that is nailed or otherwise secured to the right angle rear edge 102, and a second portion having an aperture through which an anchor (such as a nail or picture hanger hook) 122*a* is received to thereby hang the wall shelf 100 with respect to the walls 104. In order for the wall shelf 100 to be stably hung on the walls 104, the center of gravity thereof should be located a distance further from the truncation 102*a* than the distance the mounting members 112 are located from the truncation. Accordingly, the mounting members 112 are affixed to the right angle rear edge closely spaced from the truncation 102*a*. This has the further advantage of artificial flowers 124 placed upon the shelf member 110 hiding the mounting members 112, as indicated at FIG. 2.

The receptacle 116 is in the form of a bore, preferably a blind bore 128, having an opening 128*a* at the top surface 110*a* of the shelf member 110 and passes into the stabilizing member 114. The orientation of the blind bore 128 is perpendicular to the top surface 110*a*. The blind bore 128 has a blind terminous 128*b* situated deeply into the stabilizing member, as shown by FIG. 4.

Figure 5:
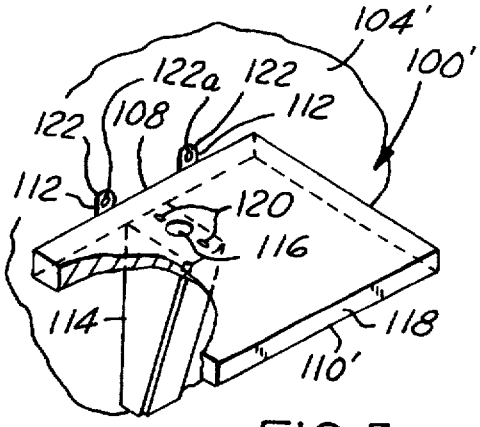
FIG. 5 is a partly sectional perspective view of wall shelf according to the present invention, shown in operation abuttingly interfaced with respect to a flat wall.

Turning attention now to FIG. 5, all the above recounted features of the wall shelf 100 apply to the wall shelf 100', however, now the shelf member 110' is generally rectilinearly shaped. The rear edge 108 of the shelf member 110', as mentioned hereinabove, is straight for abuttingly interfacing with a flat wall 104'. It will be noted that the mounting members 112 are located at the rear edge 108. Consequently, all like functioning components of the wall shelf 100' are indicated by the same numerals as used for the wall shelf 100, and no further explanation is needed.

In operation, a user mounts the wall shelf 100, 100' to a wall 104, 104'. Thereupon, the user places an object upon the shelf member 110, 110'. Particularly in this regard, the user places stems 126 of artificial flowers 124 into the receptacle 116, whereupon the flowers are anchored to the wall shelf. The wall shelf and the flowers provide a decorative synergism unmatched by a conventional shelf.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A wall shelf for being connected with a wall, comprising:

a shelf member having a top surface and an opposite bottom surface, said shelf member having a rear edge;

a stabilizing member connected with said bottom surface of said shelf member;

mounting means for connecting said shelf member hangably to a wall; and a receptacle formed in said shelf member and said stabilizing member, wherein said receptacle comprises a bore passing through said shelf member and into said stabilizing member, said bore being open at said top surface of said shelf member.

2. The wall shelf of claim 1, wherein said receptacle comprises a blind bore formed in said shelf member and said stabilizing member, said blind bore having a blind terminous inside said stabilizing member.

3. The wall shelf of claim 1, wherein said rear edge is a right angle for being abutted with respect to complementary walls of a wall corner.

4. The wall shelf of claim 3, wherein said rear edge is truncated by a truncation of said shelf member; wherein said stabilizing member coterminally adjoins said truncation.

5. The wall shelf of claim 3, wherein said mounting means is located at said rear edge, said mounting means being spaced proximately with respect to said truncation.

6. The wall shelf of claim 5, wherein said receptacle comprises a blind bore formed in both said shelf member and said stabilizing member, said blind bore having a blind terminous inside said stabilizing member.

7. The wall shelf of claim 1, wherein said rear edge is straight; wherein said stabilizing member coterminally adjoins said rear edge.

8. The wall shelf of claim 7, wherein said mounting means is located at said rear edge.

9. The wall shelf of claim 8, wherein said receptacle comprises a blind bore formed in both said shelf member and said stabilizing member, said blind bore having a blind terminous inside said stabilizing member.

10. A wall shelf for being connected with a wall, comprising:

a shelf member having a top surface and an opposite bottom surface, said shelf member having a rear edge;

a stabilizing member connected with said bottom surface of said shelf member;

mounting means for connecting said shelf member hangably to a wall; and a receptacle formed in said shelf member and said stabilizing member, wherein said receptacle comprises a blind bore passing through said shelf member and into said stabilizing member, said blind bore having an opening in said top surface of said shelf member, said blind bore having a blind terminous inside said stabilizing member.

11. The wall shelf of claim 10, wherein said rear edge is a right angle for being abutted with respect to complementary walls of a wall corner.

12. The wall shelf of claim 11, wherein said rear edge is truncated by a truncation of said shelf member; wherein said stabilizing member coterminally adjoins said truncation.

13. The wall shelf of claim 12, wherein said mounting means is located at said rear edge, said mounting means being spaced proximately with respect to said truncation.

14. The wall shelf of claim 10, wherein said rear edge is straight; wherein said stabilizing member coterminally adjoins said rear edge.

15. The wall shelf of claim 14, wherein said mounting means is located at said rear edge.

16. A wall shelf and artificial flower combination for being connected with a wall, comprising:

at least one artificial flower having at least one stem; and a wall shelf, comprising:

a shelf member having a top surf ace and an opposite bottom surface, said shelf member having a rear edge;

a stabilizing member connected with said bottom surface of said shelf member;

mounting means for connecting said shelf member hangably to a wall; and a receptacle formed in said shelf member and said stabilizing member, wherein said receptacle comprises a blind bore passing through said shelf member and into said stabilizing member, said blind bore having an opening in said top surface of said shelf member, said blind bore having a blind terminous inside said stabilizing member;

wherein said at least one stem is received in said receptacle to thereby anchor said at least one artificial flower to said wall shelf.

17. The wall shelf and artificial flower combination of claim 16, wherein said mounting means is located at said rear edge; further wherein said stabilizing member coterminally adjoins said rear edge.

18. The wall shelf and artificial flower combination of claim 17, wherein said rear edge is straight.

19. The wall shelf and artificial flower combination of claim 17, wherein said rear edge is a right angle for being abutted with respect to complementary walls of a wall corner.

20. The wall shelf and artificial flower combination of claim 19, wherein said rear edge is truncated by a truncation of said shelf member; wherein said stabilizing member coterminally adjoins said truncation.

* * * * *